United States Patent [19]

Schlick

[11] 4,272,244

[45] Jun. 9, 1981

[54] DISPERSE DYEING OF POLYVINYL CHLORIDE-ACETELIZED POLYVINYL ALCOHOL FIBERS

[75] Inventor: Bernhard Schlick, Basel, Switzerland

[73] Assignee: Sandoz Ltd., Basel, Switzerland

[21] Appl. No.: 18,294

[22] Filed: Mar. 6, 1979

[30] Foreign Application Priority Data

Mar. 6, 1978 [CH] Switzerland ..... 2403/78

[51] Int. Cl.[3] ..... D06P 3/82; D06P 1/64; D06P 1/62

[52] U.S. Cl. ..... 8/529; 8/583; 8/607; 8/616; 8/617

[58] Field of Search ..... 8/21 R, 94 A, 92, 83, 8/173, 175, 529, 583, 607, 616, 617

[56] References Cited

U.S. PATENT DOCUMENTS

| | | | |
|---|---|---|---|
| 4,121,899 | 10/1978 | Von Chambers et al. | 8/94 A |
| 4,131,424 | 12/1978 | Cororos et al. | 8/94 A |

FOREIGN PATENT DOCUMENTS

| | | | |
|---|---|---|---|
| 2051671 | 5/1972 | Fed. Rep. of Germany | 8/94 A |
| 2233261 | 7/1973 | Fed. Rep. of Germany | 8/94 A |
| 1094157 | 5/1955 | France . | |
| 1288828 | 12/1962 | France . | |
| 1000407 | 2/1963 | United Kingdom . | |

OTHER PUBLICATIONS

The International Dyer and Printer, p. 81 3(1964) by R. W. Moncrieff.

*Primary Examiner*—William F. Hamrock

*Attorney, Agent, or Firm*—Gerald D. Sharkin; Richard E. Vila; Thomas C. Doyle

[57] ABSTRACT

A process for dyeing without shrinkage with a disperse dyestuff or an optical brightening agent a fibrous substrate whose fibres comprise a mixture of polyvinyl chloride and acetalized polyvinyl alcohol, in which the substrate is dyed at a temperature from 60° to 90° C. in the presence of a levelling carrier, this levelling carrier being removable when the dried substrate is subsequently submitted to a dry heat treatment for a period up to 120 seconds and at a temperature from 95° to 135° C.

18 Claims, No Drawings

DISPERSE DYEING OF POLYVINYL CHLORIDE-ACETELIZED POLYVINYL ALCOHOL FIBERS

This invention relates to a process for dyeing with disperse dyestuffs a fibrous substrate whose fibres comprise a mixture of polyvinyl chloride and acetalized polyvinyl alcohol.

Fibres consisting of a mixture of polyvinyl chloride and acetalized polyvinyl alcohol (referred hereinafter as PVC/acetalized PVA fibres) are particularly valued for their soft handle when they are undyed, and for their flame-resistant properties. They are used for example in children's wear, blankets, carpets and upholstery. However, these fibres are sensitive to wet heat and tend to shrink and harden when treated in an aqueous medium at temperatures exceeding 90° C., as for example in dyeing processes which have hitherto been used for such fibres. Therefore, the dyeing of these fibres cannot be carried out at such temperatures without a deterioration of their handle and notable shrinkage. At lower temperatures, the dyestuffs do not build up on this fibrous substrate.

It has now been found that fibres comprising PVC/acetalized PVA may be dyed with disperse dyestuffs at a temperature below 90° without the danger of shrinking and deterioration of handle.

According to the present invention, there is provided a process for dyeing with a disperse dyestuff a fibrous substrate whose fibres comprise a mixture of polyvinyl chloride and acetalized polyvinyl alcohol, in which the substrate is dyed at a temperature from 60° to 90° C. in the presence of a levelling carrier, this levelling carrier being substantially removable when the dyed substrate is subsequently submitted, after drying, to a dry heat treatment for a period of up to 120 seconds and at a temperature from 95° to 135° C.

Suitable levelling carriers for the process of the present invention are known compounds which are usually employed as carriers having a simultaneous levelling effect for the dyeing of polyester fibres. In the case of dyeing PVC/acetalized PVA fibres, the levelling carrier is used as dyeing accelerator. Levelling carriers which are only removable under temperature conditions adversely affecting the quality of the PVC/acetalized PVA fibres and the light fastness of the dyeings on these fibres are not appropriate. As mentioned above, the levelling carrier must be substantially eliminated from the dyed substrate after the final dry heat treatment with hot air at a temperature from 95° to 135° C. and for a period up to 120 seconds. Examples of levelling carriers of this type are aromatic hydrocarbons such as alkylbenzenes, e.g. those in which the benzene nucleus is substituted by two or more methyl groups or at least one ethyl, propyl or butyl group, methyl-biphenyl or biphenyl; benzalacetone or benzalacetophenone; chlorinated hydrocarbons such as chlorinated benzene, e.g. di- or trichlorobenzene; and aromatic esters, e.g. aromatic carboxylic acid esters such as benzoates and cinnamates, for example methyl, butyl or benzyl benzoate; or mixtures thereof. Preferred levelling carriers, according to the invention, are mixtures of aromatic hydrocarbons, preferably alkylated aromatic hydrocarbons, particularly the aforementioned alkylbenzenes, and/or of aromatic carboxylic acid esters, particularly benzoates. These mixtures are commercially available.

The amount of levelling carrier present in the dye liquor may vary within a wide range, depending on such factors as the dyeing temperature, the desired depth of dyeing and the nature of the dyestuff. In general, the levelling carrier is present in the dyebath in an amount within the range 0.1 to 8 g/liter, preferably 0.5 to 4 g/liter, and more preferably 1 to 3.5 g/liter.

Dyeing may be carried out in accordance with the known methods used for exhaust dyeing. However, according to the invention, the dyeing temperature is preferably from 60° to 75° C., more preferably from 70° to 72° C. Instead of a disperse dyestuff, an optical brightening agent may be used, particularly an optical brightener of the class employable for polyester fibres. In addition to the dyestuff or the optical brightening agent and the levelling carrier, the dyebath may contain conventional additives such as levelling agents, dispersing agents of the cationic, anionic or non-ionic type, etc.

In a preferred embodiment and particularly when the levelling carrier is based on a mixture of alkylbenzenes and/or aromatic carboxylic acid esters, the levelling carrier is added to the dyebath in the form of an emulsion, preferably an aqueous emulsion. This emulsion may be prepared with the help of one or more conventional emulsifiers and optionally one or more conventional dispersing agents. Preferably, the levelling carrier is used in the form of an emulsion which provides little or no foam.

After the dyeing according to the invention has been carried out, the substrate is dried, preferably in stages. Thus, the substrate is first treated in order to eliminate the major part of its moisture, e.g. by suction, and then further dried at a temperature from 90° to 95° C. for 1 to 2 minutes. Subsequently, the dried substrate is submitted to a dry heat treatment at a temperature from 95° to 135° C., preferably from 120° to 135° C., more preferably from 130° to 135° C., for a period from 30 to 120 seconds, preferably from 30 to 60 seconds. The final drying at 90°-95° C. and the dry heat treatment at 95°-135° C. are preferably effected on a drying stenter, which preserves the dimensional stability of the substrate. Before the drying steps, the dyed substrate may be rinsed in known manner.

The fibres of the substrate to be dyed may consist of a mixture of PVC/acetalized PVA in any ratio as commercially available, or of blends of these PVC/acetalized PVA fibres with natural and/or synthetic fibres such as cotton, linen, polyester or viscose. Depending on their nature, the other types of fibres which are blended with the PVC/acetalized PVA fibres may be dyed before blending if their dyeing temperatures are too high, e.g. in the case of polyester fibres; or may be dyed in the same dyebath, e.g. with addition of reactive dyestuffs in the case of cotton. Preferred fibrous substrates dyeable according to the invention are those whose fibres consist of or comprise a mixture of PVC and acetalized PVA in a w/w ratio of between 85:15 and 45:55, particularly of 50:50, e.g. the fibres available under the trade-name "Cordelan" from Kohjin Co. Ltd., Japan.

The substrate to be dyed may be in any desired form, e.g. yarn, flocks, fabrics, etc. preferably in the form of velvet or velours.

The process of the invention enables the PVC/acetalized PVA fibres to be dyed with disperse dyestuffs at a lower temperature than by the hitherto known methods, due to the presence of the levelling carrier. Thus, the initial soft handle of the substrate is not adversely modified by the dyeing and, particularly in case of velvet or velours, the quality of the nap is preserved. Furthermore, the PVC/acetalized PVA fibres are dyed without any notable shrinking. Although it is known to use such carriers for dyeing polyester fibres at normal dyeing temperatures, i.e. at least 100° C., the dyeing of PVC/acetalized PVA fibres is effected, in this case, with good results at a temperature at which the levelling carrier is not effective when used for dyeing polyester fibres. Furthermore, such levelling carriers are believed to act by a process in which the polyester fibres are swollen, thereby causing dimensional instability in the goods. By contrast, the same compounds used as dyeing accelerators with PVC/acetalized PVA fibres do not give rise to shrinkage.

The dyeings obtained in accordance with the process of the invention exhibit a good light fastness, the levelling carrier being substantially removed from the substrate.

The invention is further illustrated by the following Examples, in which all percentages are by weight and all temperatures in degrees centigrade.

EXAMPLE 1

A PVC/acetalized PVA fabric (Cordelan-suede) is washed for 20 minutes at 60° C. with an aqueous bath containing 1 g/liter of a commercially available non-ionic surface-active agent based on a dipentylphenyl-polyglycolic ether comprising about 10 ethylene-oxy units. The goods to liquor ratio is 1:30.

This fabric is then dyed, in a goods to liquor ratio of 1:30, with a dyebath containing:

1 g/liter of a commercial surface active agent based on sulphonated castor oil,
1 g/liter of a commercial non-ionic levelling agent based on the addition product of ethylene oxide on a fatty acid,
1 g/liter of a commercially available levelling carrier comprising a mixture of benzyl benzoate and alkylated aromatic hydrocarbons,
0.062% of dyestuff C.I. Disperse Yellow 49,
0.023% of dyestuff C.I. Disperse Red 50, and
0.007% of dyestuff C.I. Disperse Blue 73.

This dyebath is prepared at room temperature (about 25°) and then adjusted to pH 5.5 with formic acid.

After introduction of the textile goods, the dyebath is regularly heated over the course of 50 minutes to 60°, and over the course of a further 20 minutes to 70°. After dyeing for one hour at this temperature, the dyebath is cooled to 50° over the course of 15 minutes. The fabric is then rinsed at 50° and again at room temperature. After suction, the fabric is placed on a drying stenter, dried at 90°-95° for 90 to 120 seconds and then submitted to a dry air treatment for 60 seconds at 135°.

An evenly and clearly dyed suede is obtained, with an excellent nap (good texture) and without shrinkage.

It is particularly advantageous to add the levelling carrier in such a manner that $\frac{1}{3}$ is added to the dyebath containing the dyestuff and the remaining $\frac{2}{3}$ is added when the dyebath temperature has reached 35° (after about 35 minutes).

EXAMPLE 2

By following the procedure of Example 1 but employing a dyebath containing:

0.22% of dyestuff C.I. Disperse Yellow 49,
0.44% of dyestuff C.I. Disperse Orange 96, and
0.04% of dyestuff C.I. Disperse Blue 73, an even, clear dyeing is obtained with a good handle.

EXAMPLE 3

By following the procedure of Example 1 but employing a dyebath containing:

1 g/liter of the non-ionic levelling agent of Example 1,
1 g/liter of the surface active agent of Example 1,
2.5 g/liter of the levelling carrier of Example 1,
0.15% of dyestuff C.I. Disperse Yellow 49,
0.2% of dyestuff C.I. Disperse Blue 19, and
6.0% of dyestuff C.I. Disperse Black 13, a clear, even black dyeing is obtained with a good handle and without shrinkage.

Similar good results are obtained if, instead of the levelling carrier described in Example 1, the same amount of a commercial methylbiphenyl or chlorinated benzene levelling carrier is used.

If a velvet or smooth fabric of "Cordelan" is dyed instead of suede, similar even and clear dyeings are obtained without shrinkage.

EXAMPLE 4

By following the procedure of Example 1 but using a dyebath containing:

1 g/liter of ammonium sulfate,
1 g/liter of a commercial dyeing auxiliary based on the addition product of ethylene oxide on a fatty acid,
1 g/liter of a commercial surface active agent based on sulphonated castor oil,
0.7 g/liter of the levelling carrier of Example 1,
0.22% of dyestuff C.I. Disperse Yellow 49,
0.44% of dyestuff C.I. Disperse Orange 20, and
0.04% of dyestuff C.I. Disperse Blue 73, in a liquor ratio of 1:60, an even dyed substrate with a good handle and without shrinkage is obtained.

EXAMPLE 5

A fabric consisting of 76% "Cordelan" fibres, 14% of linen and 10% of cotton is dyed in a liquor ratio of 1:30, with a dyebath containing:

2 g/liter of ammonium sulfate,
0.5 g/liter of the dyeing auxiliary of Example 4,
0.5 g/liter of the surface active agent of Example 4,
0.2% of dyestuff C.I. Disperse Orange 30,
0.4% of dyestuff C.I. Disperse Blue 73,
0.4% of dyestuff C.I. Disperse Yellow 49, and
2.5 g/liter of the levelling carrier of Example 1.

This dyebath is adjusted to pH 5 with acetic acid. After introduction of the textile, the dyebath is regularly heated over the course of 15 minutes to 30°, and over the course of a further 40 minutes to 70°. After the fabric has been dyed for 1 hour at 70°, the following dyestuffs are added to the dyebath:

1.6% of dyestuff C.I. Direct Yellow 27, and
0.2% of dyestuff C.I. Direct Green 26.

Five minutes later, 10 g/liter of sodium sulfate are added and the dyeing is effected for further 30 minutes at 70°. The subsequent treatments are effected as specified in Example 1. An even dyed fabric with a soft handle and without shrinkage is obtained.

What we claim is:

1. A process for dyeing with a disperse dyestuff a fibrous substrate whose fibres comprise a mixture of polyvinyl chloride and acetalized polyvinyl alcohol, which comprises dyeing the substrate at a temperature from 60° to 90° C. with a dye liquor containing a levelling carrier which is substantially removable from the substrate when the dyed or brightened substrate is subsequently submitted, after drying, to a dry heat treatment for a period of up to 120 seconds and at a temperature from 95° to 135° C.

2. A process according to claim 1, in which the substrate is dyed at a temperature from 60° to 75° C.

3. A process according to claim 1, in which the levelling carrier is present in the dyebath in an amount from 0.1 to 8 g per liter.

4. A process according to claim 1, in which the levelling carrier is an aromatic hydrocarbon, a chlorinated hydrocarbon, an aromatic carboxylic acid ester, benzalacetone or benzalacetophenone, or a mixture thereof.

5. A process according to claim 1, in which the levelling carrier is an alkylbenzene in which the benzene nucleus is substituted by two or more methyl groups or at least one ethyl, propyl or butyl group; methyl-biphenyl; biphenyl; di- or tri-chlorobenzene; or a benzoic or cinnamic acid ester; or a mixture thereof.

6. A process according to claim 1, in which the levelling carrier is a mixture of alkylbenzenes and/or of benzoic acid esters.

7. A process according to claim 1, in which the dyed substrate is subsequently dried, the final drying step being effected at a temperature from 90° to 95° C. for 60 to 120 seconds.

8. A process according to claim 1, in which the dried substrate is submitted to a dry heat treatment with hot air at a temperature from 120° to 135° C. for 30 to 120 seconds.

9. A process according to claim 1, in which the fibrous substrate consists of or comprises a mixture of polyvinyl chloride and acetalized polyvinyl alcohol in a weight ratio of 50:50.

10. A fibrous substrate whose fibres comprise a mixture of polyvinyl chloride and acetalized polyvinyl alcohol, whenever dyed by a process according to claim 1.

11. A process according to claim 4 wherein the substrate is dyed with a disperse dyestuff in the presence of, as levelling carrier, a mixture of benzyl benzoate and alkylated aromatic hydrocarbons.

12. A process according to claim 4 wherein the aromatic hydrocarbon is an alkylbenzene, methylbiphenyl or biphenyl; the chlorinated hydrocarbon is a chlorinated benzene; and the aromatic carboxylic acid ester is a benzoate or cinnamate.

13. A process according to claim 12 wherein the alkylbenzene is benzene substituted by at least two methyl groups or by at least one ethyl, propyl or butyl group; the chlorinated benzene is di- or trichlorobenzene, and the benzoate is methyl, butyl or benzyl benzoate.

14. A process according to claim 1 wherein the substrate is dyed in a dyebath.

15. A process according to claim 1 wherein the disperse dye is applied to the substrate by the exhaust method.

16. A process according to claim 14 wherein the levelling carrier is added to the dyebath in the form of an aqueous emulsion.

17. A process according to claim 1 wherein the substrate consists of or comprises polyvinyl chloride and acetalized polyvinyl alcohol in a weight ratio of 85:15 to 45:55.

18. A process according to claim 17 wherein the substrate is dyed by the exhaust method in a dyebath containing, as levelling carrier, 0.1 to 8 g. per liter of an aromatic hydrocarbon, a chlorinated hydrocarbon, an aromatic carboxylic acid ester, benzalacetone or benzalacetophenone and the dyed substrate is dried and then submitted to a dry heat treatment at a temperature of 95° to 130° C. for a period of up to 120 seconds, whereby the levelling carrier is substantially removed.

* * * * *